US009022517B2

(12) United States Patent
Arimori et al.

(10) Patent No.: US 9,022,517 B2
(45) Date of Patent: May 5, 2015

(54) RECORDING DEVICE

(71) Applicant: Seiko Epson Corporation, Tokyo (JP)

(72) Inventors: Kazuhiko Arimori, Kitakyushu (JP); Takayuki Shiota, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,201

(22) Filed: Mar. 24, 2014

(65) Prior Publication Data

US 2014/0292880 A1 Oct. 2, 2014

(30) Foreign Application Priority Data

Mar. 27, 2013 (JP) ..... 2013-067498

(51) Int. Cl.

| | |
|---|---|
| ***B41J 29/393*** | (2006.01) |
| ***B41J 19/20*** | (2006.01) |
| ***B41J 11/00*** | (2006.01) |
| ***B41J 25/00*** | (2006.01) |
| ***B41J 2/045*** | (2006.01) |

(52) U.S. Cl.

CPC ..... *B41J 19/202* (2013.01); *B41J 29/393* (2013.01); *B41J 11/0055* (2013.01); *B41J 19/205* (2013.01); *B41J 19/207* (2013.01); *B41J 25/001* (2013.01); *B41J 2/04503* (2013.01); *B41J 2/04518* (2013.01)

(58) Field of Classification Search

CPC .. B41J 19/202; B41J 2/04518; B41J 2/04503; B41J 25/001; B41J 19/205; B41J 19/207; B41J 29/393; B41J 11/0055

USPC ..... 347/19

See application file for complete search history.

(56) References Cited

U.S. PATENT DOCUMENTS

2013/0076822 A1* 3/2013 Ogimura ..... 347/14

FOREIGN PATENT DOCUMENTS

JP 4009834 9/2007

* cited by examiner

*Primary Examiner* — Julian Huffman

(74) *Attorney, Agent, or Firm* — Workman Nydegger

(57) ABSTRACT

Proper recording is performed whether a device is tilted or not while a cost increase is suppressed. A recording device includes a recording head which performs recording on a medium, a carriage which is moved in a first direction and a second direction opposite to the first direction, a guide which guides the carriage in the first direction and the second direction, a drive motor which drives the carriage, and a controller which executes a reciprocation load detection mode where a driving load on the drive motor due to a tilt of the recording device in a movement of the carriage in the first direction is detected and a driving load on the drive motor due to the tilt of the recording device in a movement of the carriage in the second direction is detected.

10 Claims, 5 Drawing Sheets

RECORDING DEVICE

BACKGROUND

1. Technical Field

The present invention relates to recording devices such as facsimile machines and printers.

2. Related Art

An ink jet printer, which is an example of a recording device, will hereinafter be described. An example of an ink jet printer is a so-called serial type printer in which an ink jet recording head that ejects ink onto paper, which is an example of a medium, is mounted on a carriage reciprocatable in a paper width direction (a main scanning direction), which is a direction intersecting a paper transport direction. The serial type ink jet printer performs recording on paper while alternately performing a main scanning movement of the carriage and a predetermined amount of paper transport movement (note that the main scanning movement of the carriage and the paper transport movement may be performed at the same time).

A controller which controls a motor which drives a carriage performs PID control in accordance with a deviation of an actual speed value of the carriage from a target speed value, which is obtained by a subtractor. In PID control, for example, a drive current of the motor is controlled so that the motor is accelerated or decelerated in accordance with an acceleration curve and a deceleration curve based on a predetermined target speed table. In such PID control, coefficients (gains) for a proportional term (P), an integral term (I), and a derivative term (D) are adjusted for optimal control (see, for example, Japanese patent No. 4009834).

The ink jet printer is usually placed on a flat surface but may be placed on a sloping surface in some cases. In particular, a small, lightweight, and portable recording device may be often used while not being horizontal. In such a case, paper may be transported while being excessively slanted, which may cause defective paper transport.

In addition, in such a case, a driving load on a carriage may vary between back and forth movements. For example, in the case where the device is tilted in a manner such that a forward movement of the carriage goes up a slope and a backward movement goes down the slope, the driving load of the former is larger than that of the latter. As a result, for example, in the backward movement (when the carriage goes down the slope), the carriage may stop beyond a target position, causing an inappropriate recording result.

A sensor dedicated to detecting the tilt of the device could be provided in order to solve the above problem; however, this unfavorably increases the cost of the device. This technical problem is not taken into consideration in the ink jet printer described in Japanese Patent No. 4009834.

SUMMARY

An advantage of some aspects of the invention is that proper recording is performed regardless of whether the device is tilted or not while a cost increase is suppressed.

In order to solve the above-described problems, a recording device according to a first aspect of the invention includes a recording head which performs recording on a medium, a carriage which is moved in a first direction and a second direction opposite to the first direction, a guide which guides the carriage in the first direction and the second direction, a drive motor which drives the carriage, and a controller which executes a reciprocation load detection mode where a driving load on the drive motor due to a tilt of the recording device in a movement of the carriage in the first direction is detected and a driving load on the drive motor due to the tilt of the recording device in a movement of the carriage in the second direction is detected.

According to the first aspect of the invention, the controller included in the recording device can execute the reciprocation load detection mode where the driving load on the drive motor due to the tilt of the recording device in the movement of the carriage in the first direction is detected and the driving load on the drive motor due to the tilt of the recording device in the movement of the carriage in the second direction is detected. Thus, a degree of the tilt of the device along the direction of the movement of the carriage can be obtained referring to the amount of difference between the driving load on the drive motor in the movement of the carriage in the first direction and that in the movement of the carriage in the second direction.

Accordingly, without using a dedicated detector to detect the tilt of the device, i.e., without increasing the cost, defective recording caused by performing recording while the device is tilted can be reduced or prevented.

According to a second aspect of the invention, it is preferable that, in the first aspect of the invention, the controller transmits an alert via an user interface included in the recording device when the amount of difference between the driving load on the drive motor due to the tilt of the recording device in the movement of the carriage in the first direction and the driving load on the drive motor due to the tilt of the recording device in the movement of the carriage in the second direction is greater than a predetermined threshold value.

According to this aspect of the invention, when the amount of difference is greater than the predetermined threshold value, the controller transmits the alert via the user interface included in the recording device, whereby a decrease in quality of the recording result caused by performing recording while the device is tilted can be prevented.

According to third and fourth aspects of the invention, it is preferable that the recording device according to the first and second aspects of the invention further includes a speed detector which detects a speed of the carriage, in which the controller controls the drive motor on the basis of a difference between a detected speed of the carriage and a target speed of the carriage during a recording process. In addition, it is preferable that the speed detector includes a linear sensor and a linear scale, and the speed of the carriage can be detected as the carriage moves.

According to the third and fourth aspects of the invention, the controller controls the drive motor on the basis of the difference between the detected speed of the carriage and the target speed of the carriage during the recording process; therefore, even when recording is performed while the device is tilted, a preferable printing result can be obtained. For example, control gains for PID control of the driver motor are corrected on the basis of the difference between the detected speed of the carriage and the target speed of the carriage, whereby a favorable recording result can be obtained even when recording is performed while the device is tilted.

According to a fifth aspect of the invention, it is preferable that the device according to any of the first to fourth aspects of the invention further includes a medium support tray which supports a medium before the medium is fed, in which the medium support tray includes an edge guide which regulates an edge position of the medium supported by the medium supporting tray at an edge of the medium on a second direction side. In a configuration where the controller performs a predetermined process when the amount of difference between the driving load on the drive motor in the movement of the carriage in the first direction and that in the movement of the carriage in the second direction is greater than the predetermined threshold value, the threshold value in the case where the position of the guide on the first direction side is higher than on the second direction side is lower than the threshold value in the case where the position of the guide on the second direction side is higher than on the first direction side.

The medium support tray which supports the medium before the medium is fed includes the edge guide which regulates the edge position of only the second direction side of the medium. If the device is tilted in a manner such that the medium is supported by the edge guide, the medium is relatively hard to skew. On the other hand, if the device is tilted in the opposite direction, i.e., the, direction without the edge guide, the edge position of the medium is not regulated by the edge; accordingly, the skew is remarkable. In this aspect, therefore, the threshold value in the case where the device is tilted in the direction in which the medium is supported by the edge guide is lower than in the case where the device is tilted in the direction opposite thereto. Therefore, recording can be performed even when the device is tilted to a certain degree.

In other words, if the recording stops in a uniform way when the device is tilted regardless of the direction, the recording might stop even when the recording could be performed, which is not preferable. Such a problem can be solved in accordance with this aspect of the invention.

According to a sixth aspect of the invention, it is preferable that, in the device according to any of the first to fifth aspects of the invention, the controller performs a skew correction mode in which skew of the medium is corrected by making a leading portion of the medium follow a medium transport roller which is provided on an upstream side of the recording head along a medium transport path. In addition, the number of times the skew correction mode is performed is increased if the amount of difference between the driving load on the drive motor in the movement of the carriage in the first direction and that in the movement of the carriage in the second direction is large, from the number of times the skew correction mode is performed in the case where the amount of difference is small.

According to this aspect of the invention, the number of times the skew correction mode is performed in the case where the amount of difference is large, is increased from the number of times the skew correction mode is performed in the case where the amount of difference is small; therefore, the skew of the medium can be corrected appropriately, taking the tilt of the device into consideration.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described with reference to the drawings.

Figure 1:
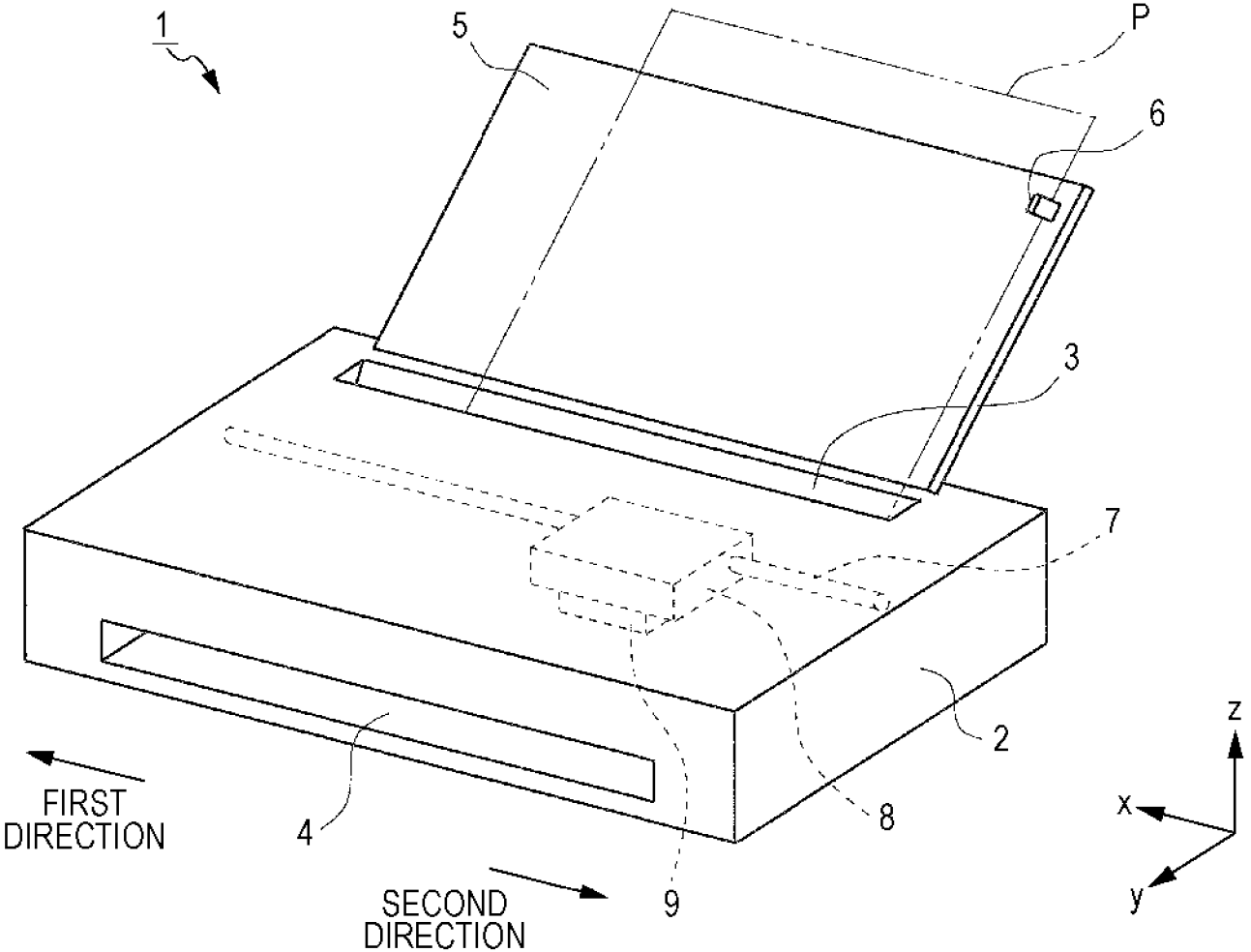
FIG. 1 is a perspective appearance view of a printer according to the invention.
Figure 2:
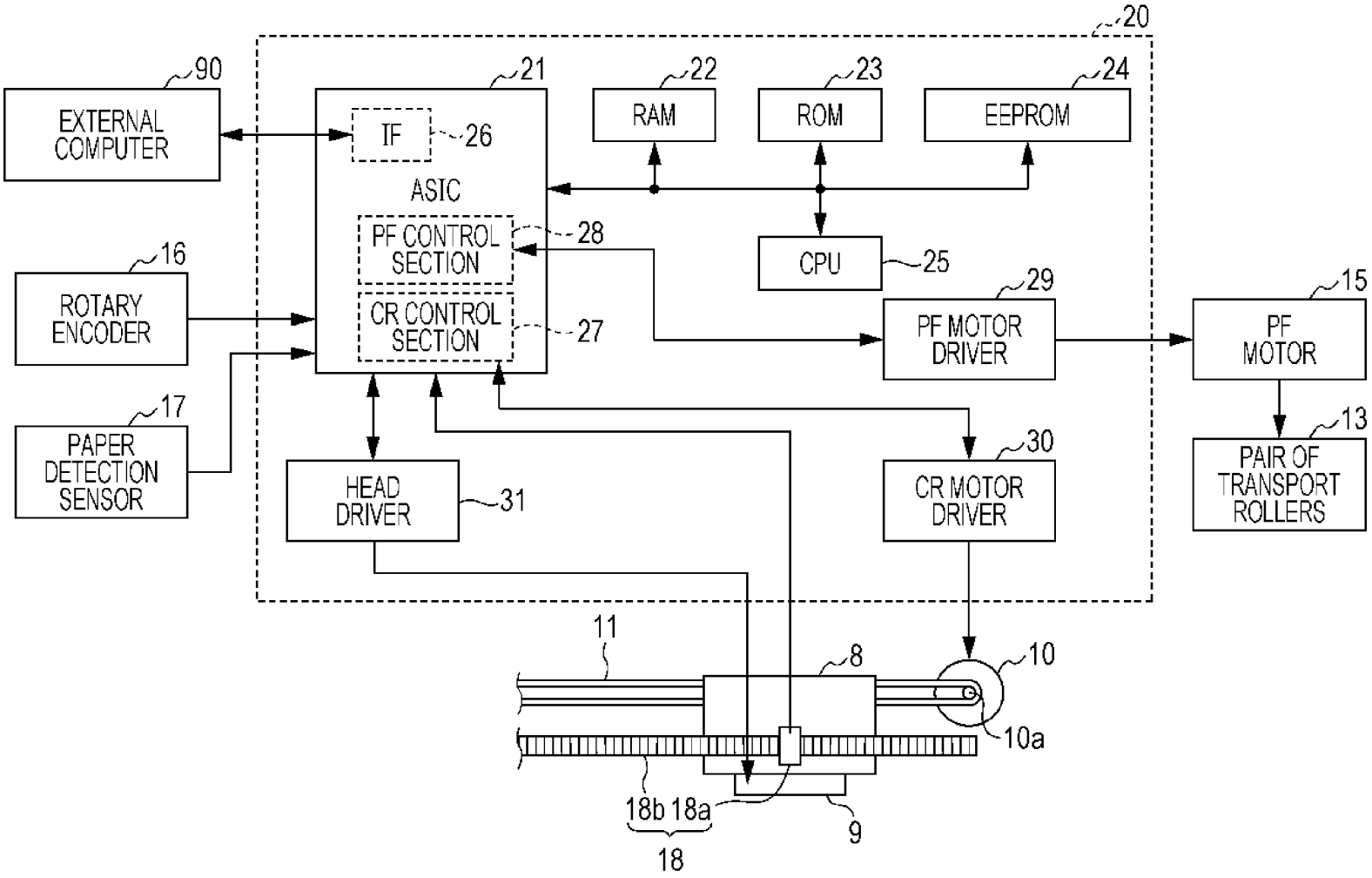
FIG. 2 is a block diagram illustrating a configuration of a printer according to the invention.
Figure 3:
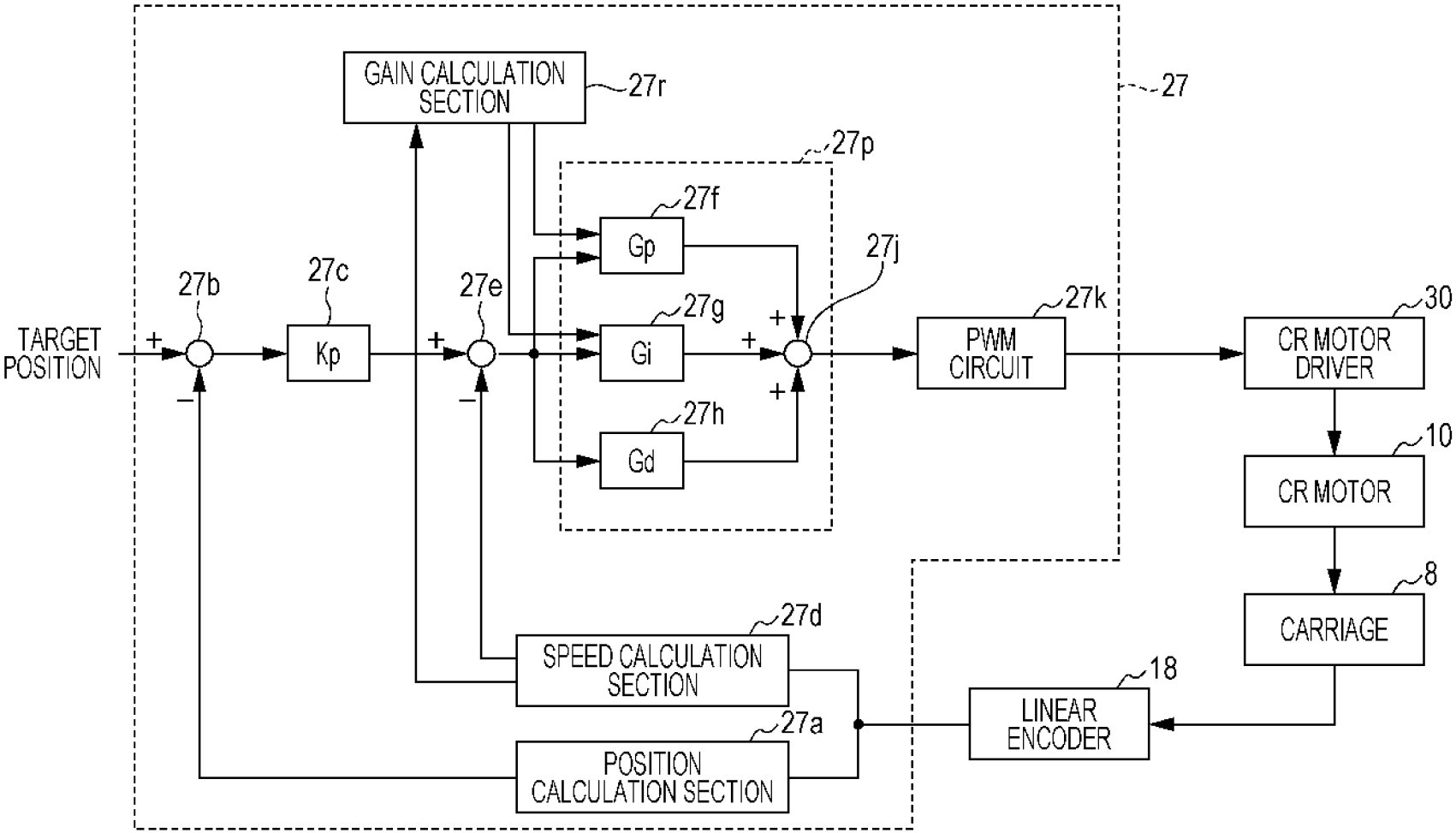
FIG. 3 is a block diagram illustrating a control system of a CR motor which drives a carriage.
Figure 4A:
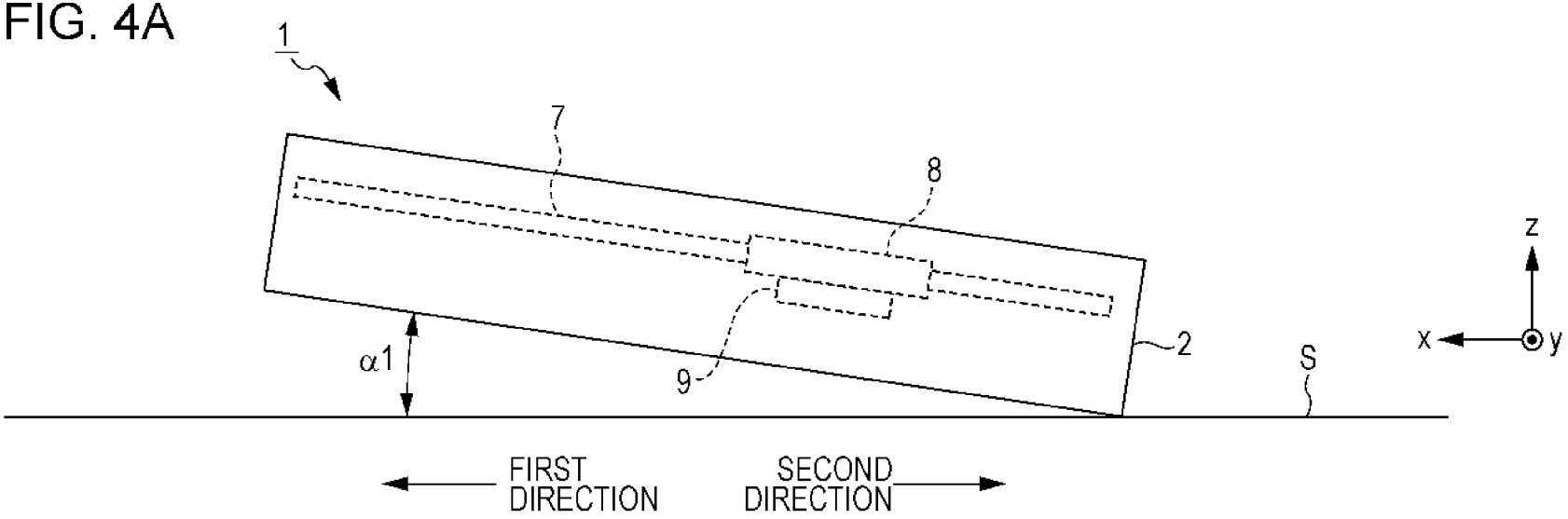
FIG. 4A is a front view of a device exemplifying a case in which the printer is tilted and a first direction side is higher than a second direction side and FIG. 4B is a front view of a device exemplifying a case in which the printer is tilted and the second direction side is higher than the first direction side.
Figure 4B:
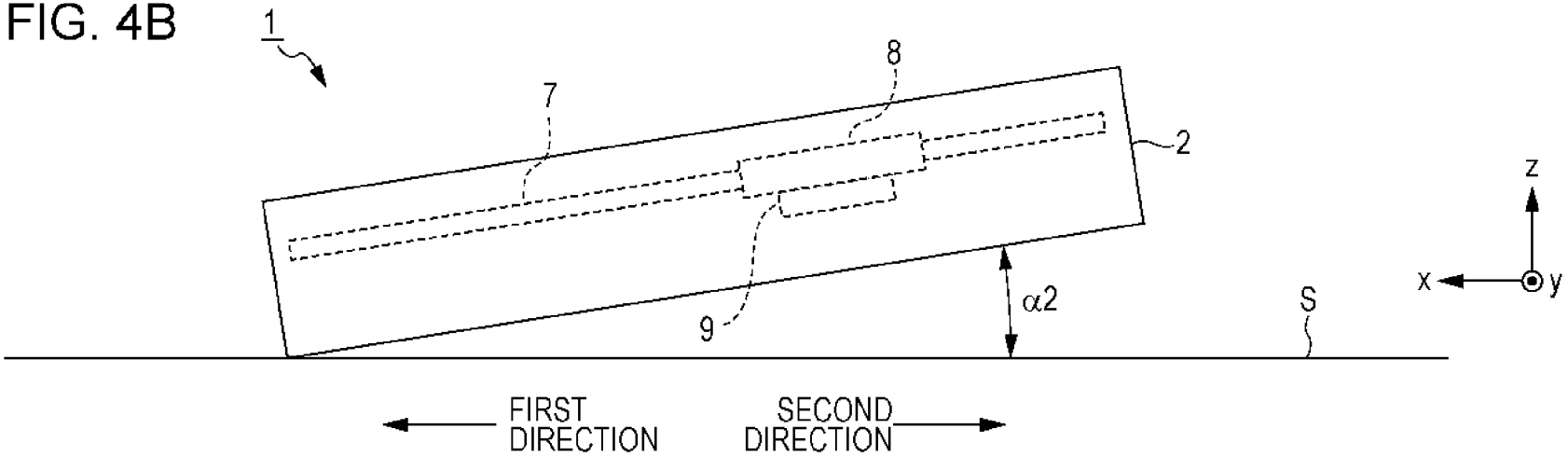
Figure 5:
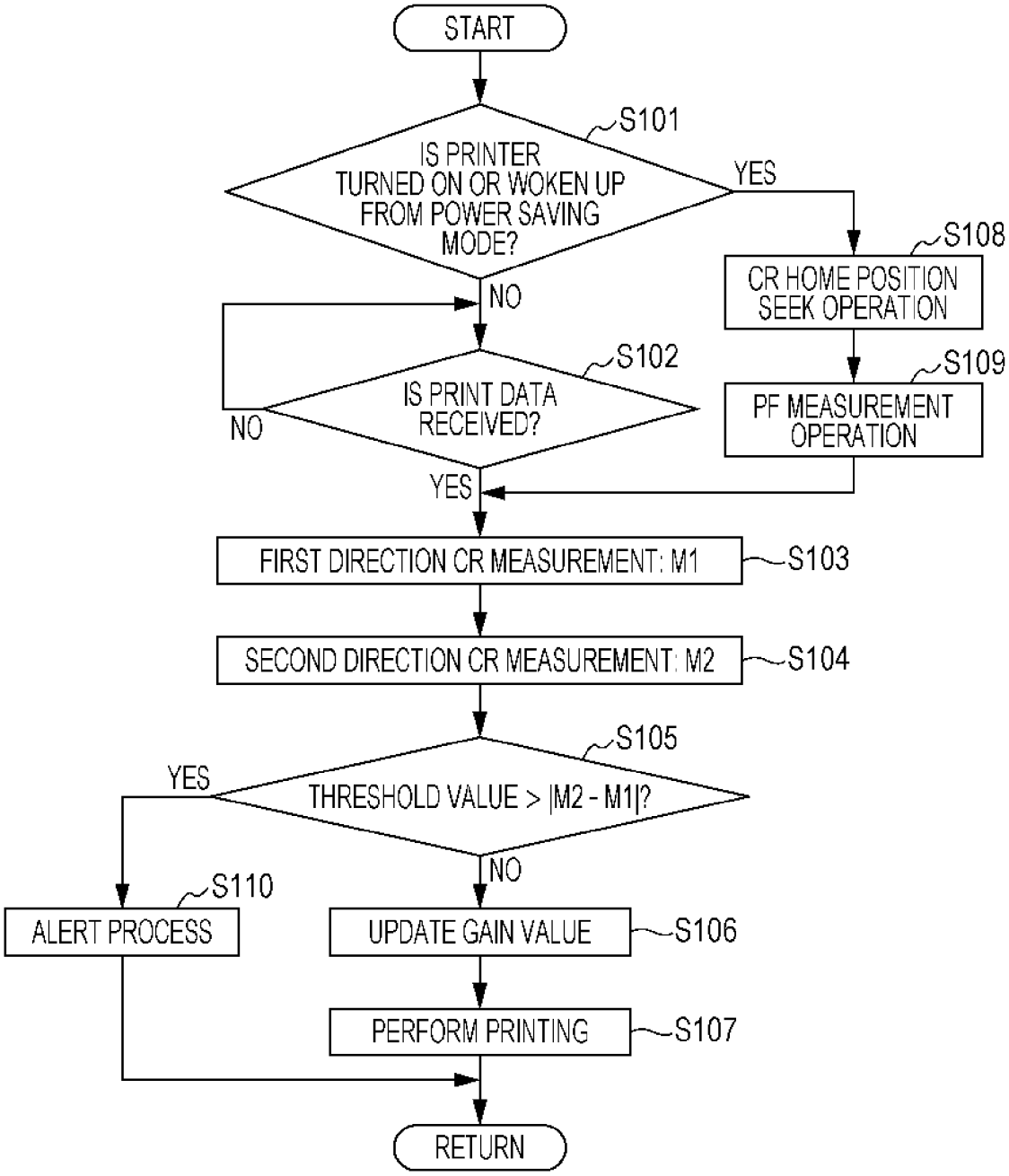
FIG. 5 is a flow chart illustrating processing of a control section.

FIG. 1 is a perspective appearance view of an ink jet printer (hereinafter referred to as a "printer") 1, which is an example of the recording device of the invention. FIG. 2 is a block diagram illustrating a configuration of the printer 1. FIG. 3 is a block diagram illustrating a control system of a CR (carriage) motor 10 which drives a carriage 8. FIG. 4A is a front view of a device exemplifying a case in which the printer 1 is tilted and a first direction side is higher than a second direction side and FIG. 4B is a front view of a device exemplifying a case in which the printer is tilted and the second direction side is higher than the first direction side. FIG. 5 is a flow chart illustrating processing of a control section 20.

An X-Y-Z rectangular coordinate system is illustrated in FIG. 1 and FIGS. 4A and 4B. The X direction and the Y direction represent a horizontal direction. The X direction is a paper width direction, a width direction of the device, and a direction in which the carriage 8 moves. The X+ direction (the direction toward the left side of the FIG. 1 and FIGS. 4A and 4B) is referred to as a "first direction", while the X− direction (the direction toward the right side of the FIG. 1 and FIGS. 4A and 4B) is referred to as a "second direction". The Y direction is a paper transport direction and a length direction of the device. The Z direction is the direction of gravity and a height direction of the device.

The appearance of the printer 1 is illustrated in FIG. 1 as a device housing 2. The size and the shape of the printer 1 are made small and thin to ensure portability. On the back side of the device, a support tray 5 which is tilted is provided to support paper P, which is an example of a medium. A paper inlet 3 is provided at the back of the upper side of the device through which the paper P is introduced. The support tray 5 can be opened and closed; the support tray 5 supports the paper P in a tilted position when open (in FIG. 1) and covers the upper surface of the device housing 2 when close (not shown). A paper outlet 4 is provided on the front side of the device. The paper P which has been subjected to recording is ejected through the paper outlet 4.

The support tray 5 has an edge guide 6 on a second direction side. The edge guide 6 regulates an edge position of the paper P. When the paper P is set on the support tray 5, the edge of the paper P on the second direction side is made to be in contact with the edge guide 6. That is, a reference position of the paper P to be transported is on the second direction side in the printer 1.

In the device, a carriage guide shaft 7 which extends in the X direction and serves as a guide is provided. The carriage guide shaft 7 guides the carriage 8 in the X direction. On the underside of the carriage 8, an ink jet recording head 9 which ejects ink is provided. The carriage 8 moves in the X direction, with the ink jet recording head 9 ejecting the ink, whereby recording is performed on the paper P. An ink cartridge (not shown) is detachably provided in the underside of the device. The ink cartridge and the ink jet recording head 9 are connected to each other by an ink tube (not shown).

The carriage 8 is driven by the CR (carriage) motor 10. In FIG. 2, a reference numeral 10*a* denotes a driving pulley mounted on a rotation axis of the CR motor 10. An endless belt 11 is loaded around the driving pulley 10*a* and a driven pulley which is provided on the left side in FIG. 2 (not shown). The carriage 8 is fixed to the endless belt 11; accordingly, as the endless belt 11 is moved in accordance with the rotation of the CR motor 10, the carriage 8 moves in the X direction.

The carriage 8 includes a linear sensor 18*a* which is a part of a linear encoder 18 serving as a "speed detector". The linear sensor 18*a* includes a light emitting section (not shown) and a light receiving section (not shown). The light emitting section and the light receiving section are provided so that a linear scale 18*b* which extends in the X direction is interposed therebetween. As the carriage 8 moves, the linear sensor 18*a* moves along the linear scale 18*b* having multiple slits and transmits a rectangular signal corresponding to the slits by which the linear sensor 18*a* has passed to the control section 20 serving as a controller. Thus, the control section 20 can detect the position and speed of the carriage 8 in the main scanning direction.

In the device, the paper P is transported by a pair of transport rollers 13 (in FIG. 2), which is not illustrated in FIG. 1. The pair of transport rollers 13 is provided on an upstream side of and close to the ink jet recording head 9 in the paper transport path. The pair of transport rollers 13 is driven by a PF motor 15 (in FIG. 2).

An object to be rotated by the PF motor 15, for example, the pair of transport rollers 13, includes a disk-shaped rotary scale (not shown) which is a part of a rotary encoder 16. The rotary encoder 16 includes a sensor including a light emitting section (not shown) and a light receiving section (not shown). The light emitting section and the light receiving section are provided so that the rotary scale is interposed therebetween. As the PF motor 15 rotates, the rotary encoder 16 moves along the rotary scale having multiple slits and the rotary encoder 16 transmits a rectangular signal corresponding to the slits by which the rotary encoder 16 has passed to the control section 20 serving as a controller. Thus, the control section 20 can detect the rotation amount and rotation speed of the pair of transport rollers 13.

In addition, a paper detection sensor 17 is provided in the paper transport path (for example, on an upstream side of and close to the pair of transport rollers 13 which is on an upstream side of the ink jet recording head 9). The control section 20 detects the transport of the paper P on the basis of the detection signal transmitted from the paper detection sensor 17 and performs necessary control.

Next, with reference to FIG. 2, configurations related to the control section 20 will be described.

A RAM 22, a ROM 23, an ASIC 21, a CPU 25, and an EEPROM (non-volatile memory) 24 are connected to a system bus of the control section 20.

Output signals from the rotary encoder 16, the linear encoder 18, the paper detection sensor 17, a power switch (not shown) to turn on or off the printer 1, and other setting buttons (not shown) are input to the CPU 25 via the ASIC 21. The CPU 25 performs a calculation process for controlling recording performed by the printer 1 and other necessary calculation processes on the basis of the output signals and the like from the sensors, switches, and the like.

A recording control program (a firmware) and the like which are necessary for control of the printer 1 by the CPU 25 are stored in the ROM 23. Plural types of data and the like which are necessary for processing of the recording control program are stored in the EEPROM 24. The RAM 22 serves as a work area of the CPU 25 or a temporary storage area for recording data and the like.

The ASIC 21 includes a control circuit for rotation control of the PF motor 15 and the CR motor 10, which are DC motors, and for driving control of the ink jet recording head 9.

A reference numeral 27 denotes a CR control section that performs rotation control of the CR motor 10. The CR control section 27 calculates a present speed of the carriage 8 on the basis of a pulse signal (a pulse cycle) output from the linear encoder 18. The CR control section 27 also performs PID control (feedback control) on the CR motor 10 in each short period of time (also referred to as a PID control cycle) so that the speed of the carriage 8 follows the predetermined speed profile (a control step).

A PF control section 28 similarly calculates a present rotation speed (which is proportional to the rotation amount) of the pair of transport rollers 13 on the basis of a pulse signal (a pulse cycle) output from the rotary encoder 16. The PF control section 28 also performs PID control (feedback control) on the PF motor 15 so that the speed of the pair of transport rollers 13 follows the predetermined speed profile. The PF motor 15 and the PF control section 28 are connected via a PF motor driver 29.

The ASIC 21 calculates a control signal for the ink jet recording head 9 on the basis of recording data or the like output from the CPU 25, and outputs the control signal to a head driver 31 to drive and control the ink jet recording head 9. The ASIC 21 further includes an IF 26 which transmits/receives data to/from an external computer 90 and the like serving as a data processor.

FIG. 3 is a block diagram mainly illustrating the CR control section 27 in detail. The CR control section 27 has a control function of controlling driving of the CR motor 10. Upon receiving a target position of the carriage (i.e., a target rotation amount of the CR motor 10) from the CPU 25, the CR control section 27 controls the CR motor 10 in accordance with the input value. The CR control section 27 includes a position calculation section 27*a*, subtractors 27*b* and 27*e*, a target speed calculation section 27*c*, a speed calculation section 27*d*, a proportional element 27*f*, an integration element 27*g*, a differential element 27*h*, an adder 27*j*, a PWM circuit 27*k*, a PID calculation section 27*p*, and a gain calculation section 27*r*.

The position calculation section 27*a* detects rising edges and falling edges of a pulse signal output from the linear encoder 18 and counts the number of detected edges in order to calculate a present position of the carriage 8 (the actual rotation amount of the CR motor 10). The subtractor 27*b* calculates a positional deviation (a rotation amount deviation) of the position obtained by the position calculation section 27*a* (the actual rotation amount of the CR motor 10) from the target position (the target rotation amount of the CR motor 10) output from the CPU 25.

The target speed calculation section 27*c* calculates a target speed of the carriage 8 (the target rotation speed of the CR motor 10) in accordance with the positional deviation, which is output from the subtractor 27*b*, and the speed profile. This calculation is a multiplication of the positional deviation by a gain Kp. The gain Kp is determined in accordance with the positional deviation. The speed calculation section 27*d* calculates the present speed of the carriage 8 (the actual rotation speed of the CR motor 10) at the time intervals of detection of the edges of the pulse signal output from the linear encoder 18. The subtractor 27*e* calculates a speed deviation of the speed calculated by the speed calculation section 27*d* from the target speed.

The PID calculation section 27*p* includes calculation elements such as the proportional element 27*f*, the integration element 27*g*, and the differential element 27*h*, and the adder 27*j*. The PID calculation section 27*p* can perform adaptive PID calculation where characteristics are changed by constants (gains) of the calculation elements which are updated as needed. The proportional element 27*f* multiples the speed deviation by a proportional gain Gp, and outputs the multiplication result. The integration element 27*g* integrates the multiple of the speed deviation by an integration gain Gi, and outputs the integration result. The differential element 27*h* multiplies the difference between the present speed deviation and the previous speed deviation by a differential gain Gd, and outputs the multiplication result.

The outputs from the proportional element 27*f*, the integration element 27*g*, and the differential element 27*h* are added by the adder 27*j*. The result of the addition, i.e., a control amount for driving the CR motor 10 is transmitted to the PWM circuit 27*k*. The PWM circuit 27*k* determines a duty ratio DR which corresponds to the control amount output from the adder 27*j* and outputs the duty ratio DR to a CR motor driver 30.

The CR motor driver 30 performs a pulse width modulation on a DC voltage, which is a power source voltage, on the basis of the duty ratio DR (i.e., a ratio of ON period to one pulse cycle) to generate a PWM signal as a pulse, and outputs the PWM signal to the CR motor 10. The CR motor 10 is a DC motor which drives using the PWM signal output from the CR motor driver 30 as a drive power source. In other words, the CR motor 10 generates a torque corresponding to the PWM signal (the duty ratio DR of the PWM signal). As the duty ratio DR of the PWM signal becomes higher, the mean value of a voltage Vm and a current Im which are applied to the CR motor 10 become higher, and the torque of the CR motor 10 is accordingly increased.

The gain calculation section 27*r* corrects the constants for the calculation performed by the calculation elements in the PID calculation section 27*p* in accordance with a detected speed fluctuation quantity of the carriage 8 (i.e., a rotation speed fluctuation quantity of the CR motor 10), thereby optimizing the constants (a gain correction process). The CPU 25 reads out and executes a program stored in the ROM 23 so that the ASIC 21 performs the gain correction process.

The configuration of the printer 1 has been described so far. Next, a reciprocation load detection mode performed by the control section 20 will be described with reference to FIGS. 4A and 4B and FIG. 5.

In FIG. 4A, the printer 1 is in a tilted state (with a tilt angle $\alpha$1) where, along the X direction, the first direction side of the printer 1 is higher than the second direction side. In FIG. 4B, the printer 1 is in a tilted state (with a tilt angle $\alpha$2) where, along the X direction, the second direction side of the printer 1 is higher than the first direction side. A reference symbol S denotes a place (e.g., a horizontal surface) on which the printer 1 is placed.

In FIG. 4A, the driving load for driving the carriage 8 moving in the first direction is larger that of the second direction. In FIG. 4B, the driving load for driving the carriage 8 moving in the second direction is larger that of the first direction. Accordingly, the control section 20 can detect the tilt of the printer 1 along the X direction on the basis of the difference between the driving loads.

Further description will be given with reference to FIG. 5. When the printer 1 is turned on or woken up from a power saving mode (YES in Step S101), a home position seek operation is performed to detect a home position of the carriage 8 (Step S108), and then a PF measurement operation is performed (Step S109). Note the home position of the carriage 8 is an end on the second direction side in a movement area of the carriage 8 in this embodiment mode.

The PF measurement operation in Step S109 is a known method where a drive current value of the PF motor 15 when a roller driving load on the pair of nip transport rollers 13 is in a vid state (a state without paper) is measured, and the mean value of the motor current is calculated by integrating the measured motor drive current, whereby a driving load on a paper feeding mechanism is indirectly measured. Thus obtained mean value of the motor drive current is used as a drive current value for transporting the paper later. Note that, strictly speaking, when the paper is provided, the drive current value is increased from the measured value; therefore, the drive current value of the PF motor 15 is determined taking this off-set value into consideration.

In the case of NO in Step S101, the printer 1 waits for print data reception (NO in Step S102). When the print data is received (YES in Step S102), the drive current of the CR motor 10 for moving the carriage 8 from the home position in the first direction is measured, i.e., the first direction CR measurement is performed (Step S103).

This CR measurement also is a known method. The outline of the CR measurement is as follows. First, the CR motor 10 is started. Acceleration control is performed to accelerate the CR motor 10 by open loop control until a motor rotation speed V is increased to come close to a predetermined constant speed.

Once the motor rotation speed V comes close to the predetermined constant speed, PID control replaces the open loop control to start constant speed driving. While the constant speed driving is performed by PID control, a motor current value I is substantially constant. When the motor current value I becomes substantially constant, recording of the motor current value I, that is, sampling of the motor current value I at time intervals $\Delta t$ is started. The sampling of the motor current value I starts after the constant speed driving of the CR motor 10 starts by PID control and continues until a predetermined time TN has passed, whereby the motor current values I are recorded. The predetermined time TN during which the sampling of the motor current value I is performed is the time needed to perform N samplings at the time intervals $\Delta t$. The time interval $\Delta t$ and the number N of sampling may be any; the predetermined time TN during which the sampling is performed can be determined appropriately.

During the recording period of the motor current value I, each time the motor current value I is sampled at the time intervals $\Delta t$, an integral value of the motor current value I is calculated from the motor current value I and the time interval $\Delta t$ of the sampling, and the integral values are accumulated. When the motor current value I has been recorded after N sampling of the motor current value I at the time intervals $\Delta t$ over the predetermined time TN, the sum of N integral values of the motor current values I is calculated. The sum is divided by the recording period TN ($TN=\Delta t \times N$) of the motor current value I to obtain a mean value M1 of the motor current corresponding to the driving load on the CR motor 10 during the constant speed driving.

As described above, the first direction CR measurement (Step S103) is performed. The mean value M1 of the motor current which is obtained in the first direction CR measurement is updated and saved in a predetermined memory. The mean value M1 of the motor current which has been stored is called to be utilized in a drive operation of the CR motor 10 in the actual printing operation.

Note that although in the above-described motor control for the CR measurement, open loop control and PID control are performed in the acceleration driving period and the constant speed driving period, respectively; PID control may be performed using a predetermined speed table during all the acceleration driving period, the constant speed driving period, and a deceleration period.

Referring back to the flow chart in FIG. 5, after the mean value M1 of the CR motor current in the movement of the carriage 8 in the first direction is obtained as described above, the carriage 8 is moved in the second direction and the drive current of the CR motor 10 is measured in a similar manner, that is, a second direction CR measurement is performed (Step S104). An obtained mean value of the CR motor current is referred to as M2. The mean value M2 of the motor current which is obtained in the second direction CR measurement is updated and saved in a predetermined memory. The mean value M2 of the motor current which is stored is called to be utilized in drive operation of the CR motor 10 in the actual printing operation.

The above-described Step S103 of the first direction CR measurement and the Step S104 of the second direction CR measurement are included in the reciprocation load detection mode of the invention.

Then, whether an absolute value of the difference between the mean value M1 of the CR motor current obtained in the first direction CR measurement and the mean value M2 of the CR motor current obtained in the second direction CR measurement (the amount of difference between M1 and M2) is larger than a predetermined threshold value or not is judged (Step S105). Here, the absolute value indicates a degree of tilt of the printer 1 (or the carriage guide shaft 7) along the X direction. The tilt direction of the printer 1 along the X direction is determined by whether the value of M2−M1 is positive or negative. When the value M2−M1 is positive (i.e., when the driving load of the second direction CR measurement is greater than that of the first direction CR measurement), the printer is tilted as is illustrated the in FIG. 4B. On the other hand, when the value M2−M1 is negative (i.e., when the driving load of the first direction CR measurement is greater than that of the second direction CR measurement), the printer is tilted as is illustrated the in FIG. 4A.

If the absolute value is too large, a paper-feeding operation and recording operation cannot be performed properly; therefore, the limit of tilt for a proper paper-feeding operation and recording operation is obtained in an assembly process of the device, that is, the upper limit (a threshold value) of the absolute value is obtained, and is stored in a memory such as the EEPROM 24. Whether the absolute value of the difference between the mean value M1 of the CR motor current obtained in the first direction CR measurement and the mean value M2 of the CR motor current obtained in the second direction CR measurement is greater than the predetermined threshold value or not is judged (Step S105).

As a result of the judgment, when the absolute value is greater than the threshold value (YES in Step S105), an alert process is executed (Step S110) to stop the printing operation. In this alert process, for example, illumination or blinking of an error lamp (not shown) indicates a user that the tilt of the device is above the tolerance. Instead of illumination or blinking of the error lamp, error sound may be made or an error message may be displayed on a user interface screen or a printer driver in an externally connected computer.

When the absolute value is the threshold value or less (NO in Step S105), the gain value in the PID control is updated (Step S106), and printing is performed (Step S107). The gain value is updated by the gain calculation section 27*r* on the basis of the mean value M1 of the CR motor current obtained in the first direction CR measurement and the mean value M2 of the CR motor current obtained in the second direction CR measurement.

Specifically, the gain calculation section 27*r* reads out initial values of the gains (which are stored in a memory such as the EEPROM 24) for the proportional element 27*f*, the integration element 27*g*, and the differential element 27*h*, multiples the initial values by predetermined correction coefficients (which are stored in a memory such as the EEPROM 24) corresponding to the mean values M1 and M2, corrects the proportional gain Gp and the integration gain Gi, and stores the corrected proportional gain Gp and integration gain Gi. The corrected gains are used in a later printing operation.

In such a manner, when the tilt of the device is within the tolerance for a proper paper-feeding operation and recording operation, gain correction is performed so that the carriage 8 can be controlled appropriately to obtain a favorable recording result.

Note that although the CR measurement in Steps S103 and S104 is performed each time the print data is received in this embodiment, it is not limited thereto. For example, the CR measurement may be performed at predetermined time intervals while the power source is on. Further, in accordance with the CR measurement performed when the power switch is turned on or the device is woken up from a power saving mode, the CR measurement of Steps S103 and S104 may be skipped in the case where the CR measurement is performed when the power switch is turned on or the device is woken up from a power saving mode and the print data is received before the predetermined time passes thereafter.

In short, the printer 1 according to one embodiment of the invention include the ink jet recording head 9 which performs recording on the paper P, which is an example of medium, the carriage 8 which can be moved in the first direction and the second direction opposite thereto, the carriage guide shaft 7 which guides the carriage 8 in the first direction and the second direction, the CR motor 10 which drives the carriage 8, and the control section 20 which can execute the reciprocation load detection mode where the driving load on the CR motor 10 in the movement of the carriage 8 in the first direction is detected and then the driving load on the CR motor 10 in the movement of the carriage 8 in the second direction is detected.

Thus, the degree of tilt of the device (or the tilt of the carriage guide shaft 7) along the direction of the movement of the carriage 8 can be obtained by using the amount of difference (in this embodiment, the absolute value of M1−M2 in Step S105 in FIG. 5) between the driving load on the CR motor 10 in the movement of the carriage 8 in the first direction and that in the movement of the carriage 8 in the second direction.

That is, without using a dedicated detector to detect the tilt of the device, i.e., without increasing the cost, defective recording caused when executing recording while the device is tilted can be reduced or prevented.

The control section 20 executes the reciprocation load detection mode before performing recording and performs the predetermined process depending on the amount of difference between the driving load on the CR motor 10 in the movement of the carriage 8 in the first direction and that in the movement of the carriage 8 in the second direction. By thus performing a process corresponding to the tilt of the device which performs recording, an appropriate result can be obtained.

In addition, when the amount of difference is greater than the predetermined threshold value, the control section 20 transmits an alert via the user interface included in the printer 1 (hereinafter, this process is referred to as a first process), whereby decrease in the quality of a recording result caused by performing recording while the device is tilted can be prevented.

In addition, the control section 20 corrects the control gain for PID control of the CR motor 10 on the basis of the amount of difference between the detected speed of the carriage 8 and the target speed thereof (hereinafter, this process is referred to as a second process), whereby a favorable recording result can be obtained even when recording is performed while the device is tilted.

The control section 20 can also perform skew correction in which skew of the paper P is corrected by making a leading portion of the transported paper P follow the pair of transport rollers 13 driven by the PF motor 15. For example, a so-called discharging-feeding method may be employed for the skew correction in which the leading portion of the paper is transported to a downstream side of the pair of transport rollers 13 by a predetermined amount, then, rotation of a feeding roller (not shown) which is located on an upstream side of the pair of transport rollers 13 is stopped and the pair of transport rollers 13 rotates in the reverse direction to discharge the leading portion of the paper to the upstream side of the pair of transport rollers 13. In such a manner, the paper is slackened between the feeding roller and the pair of transport rollers 13 and the leading portion of the paper follows the pair of transport rollers 13, whereby skew is corrected.

The number of times the skew correction is performed is increased in the case where the amount of difference between the driving load on the CR motor 10 in the movement of the carriage 8 in the first direction and that in the movement of the carriage 8 in the second direction is large, from the number of times the skew correction is performed in the case where the amount of difference is small (hereinafter, this process is referred to as a third process), whereby skew of the paper can be appropriately corrected in accordance with the tilt of the device.

Note that the number times the skew correction is performed can be changed depending on the tilt direction of the device. The tilt direction of the device can be determined from the difference between the driving load on the CR motor 10 in the movement of the carriage 8 in the first direction and that in the movement of the carriage 8 in the second direction. In specific, in FIG. 4A, the driving load on the CR motor 10 in the movement of the carriage 8 in the first direction is larger than that in the movement of the carriage 8 in the second direction; in FIG. 4B, the driving load on the CR motor 10 in the movement of the carriage 8 in the second direction is larger than that in the movement of the carriage 8 in the first direction.

Since the support tray 5 has the edge guide 6 in the second direction side, the paper set on the support tray 5 is easily displaced to cause skew in the case of the tilt in FIG. 4B than in the case of FIG. 4A. Accordingly, the number of times the skew correction is performed is increased in the case of the tilt in FIG. 4B, from the number of skew corrections in the case of FIG. 4A.

Similarly, the threshold value (the threshold value in Step S105 in FIG. 5) in the case where the position of the device (or the carriage guide shaft 7) on the first direction side is higher than the second direction side (i.e., in the state of FIG. 4A) can be set lower than that of the case where the position of the device (or the carriage guide shaft 7) on the second direction side is higher than the first direction side (i.e., in the state of FIG. 4B) (hereinafter, this process is referred to as a fourth process).

If the recording stops in a uniform way when the device (or the carriage guide shaft 7) is tilted regardless of the direction of the tilt, the recording might stop even when the recording could be performed (for example, in the case of FIG. 4A), which is not preferable. By changing the threshold values in accordance with the direction of tilt, such a problem can be solved.

Note that the first to fourth processes can be appropriately combined with each other; all of the first to fourth processes may be employed, or any or one of the processes may be employed.

The entire disclosure of Japanese Patent Application No. 2013-067498, filed Mar. 27, 2013 is expressly incorporated by reference herein.

What is claimed is:

1. A recording device comprising:

a recording head which performs recording on a medium;

a carriage which is moved in a first direction and a second direction opposite to the first direction;

a guide which guides the carriage in the first direction and the second direction;

a drive motor which drives the carriage; and a controller which executes a tilt detection mode where a driving load on the drive motor due to a tilt of the recording device in a movement of the carriage in the first direction is detected and a driving load on the drive motor due to the tilt of the recording device in a movement of the carriage in the second direction is detected.

2. The recording device according to claim 1, wherein the controller transmits an alert via an user interface included in the recording device when an amount of difference between the driving load on the drive motor due to the tilt of the recording device in the movement of the carriage in the first direction and the driving load on the drive motor due to the tilt of the recording device in the movement of the carriage in the second direction is greater than a predetermined threshold value.

3. The recording device according to claim 2, further comprising:

a speed detector which detects a speed of the carriage, wherein the controller controls the drive motor on the basis of a difference between a detected speed of the carriage and a target speed of the carriage during a recording process.

4. The recording device according to claim 1, further comprising:

a speed detector which detects a speed of the carriage, wherein the controller controls the drive motor on the basis of a difference between a detected speed of the carriage and a target speed of the carriage during a recording process.

5. The recording device according to claim 3, wherein the speed detector includes a linear sensor and a linear scale, and wherein the speed of the carriage can be detected as the carriage moves.

6. The recording device according to claim 2, further comprising:

a medium support tray which supports a medium before the medium is fed, wherein the medium support tray includes an edge guide which regulates an edge position of the medium supported by the medium support tray at an edge of the medium on a second direction side, and wherein, in a configuration where the controller performs a predetermined process when an amount of difference between the driving load on the drive motor in the movement of the carriage in the first direction and the driving load on the drive motor in the movement of the carriage in the second direction is greater than a predetermined threshold value, the threshold value in the case where the position of the guide on the first direction side is higher than on the second direction side is lower than the threshold value in the case where the position of the guide on the second direction side is higher than on the first direction side.

7. The recording device according to claim 2, wherein the controller performs a skew correction mode in which skew of the medium is corrected by making a leading portion of the medium follow a medium transport roller which is provided on an upstream side of the recording head along a medium transport path, and wherein the number of times the skew correction mode is performed is increased in the case where the amount of difference between the driving load on the drive motor in the movement of the carriage in the first direction and the driving load on the drive motor in the movement of the carriage in the second direction is large, from the number of times the skew correction mode is performed in the case where the amount of difference is small.

8. The recording device according to claim 4, wherein the speed detector includes a linear sensor and a linear scale, and wherein the speed of the carriage can be detected as the carriage moves.

9. The recording device according to claim 1, further comprising:

a medium support tray which supports a medium before the medium is fed, wherein the medium support tray includes an edge guide which regulates an edge position of the medium supported by the medium support tray at an edge of the medium on a second direction side, and wherein, in a configuration where the controller performs a predetermined process when an amount of difference between the driving load on the drive motor in the movement of the carriage in the first direction and the driving load on the drive motor in the movement of the carriage in the second direction is greater than a predetermined threshold value, the threshold value in the case where the position of the guide on the first direction side is higher than on the second direction side is lower than the threshold value in the case where the position of the guide on the second direction side is higher than on the first direction side.

10. The recording device according to claim 1, wherein the controller performs a skew correction mode in which skew of the medium is corrected by making a leading portion of the medium follow a medium transport roller which is provided on an upstream side of the recording head along a medium transport path, and wherein the number of times the skew correction mode is performed is increased in the case where the amount of difference between the driving load on the drive motor in the movement of the carriage in the first direction and the driving load on the drive motor in the movement of the carriage in the second direction is large, from the number of times the skew correction mode is performed in the case where the amount of difference is small.

* * * * *